US009351625B2

(12) United States Patent
Carter

(10) Patent No.: US 9,351,625 B2
(45) Date of Patent: May 31, 2016

(54) STEAM CLEANERS

(71) Applicant: TECHTRONIC FLOOR CARE TECHNOLOGIES LIMITED, Tortola (VG)

(72) Inventor: Daniel Carter, Droitwich (GB)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

(21) Appl. No.: 14/399,220

(22) PCT Filed: May 8, 2013

(86) PCT No.: PCT/GB2013/051194

§ 371 (c)(1),
(2) Date: Nov. 6, 2014

(87) PCT Pub. No.: WO2013/167891

PCT Pub. Date: Nov. 14, 2013

(65) Prior Publication Data

US 2015/0113756 A1 Apr. 30, 2015

(30) Foreign Application Priority Data

May 8, 2012 (GB) ..... 1208022

(51) Int. Cl.

| | |
|---|---|
| ***A47L 11/34*** | (2006.01) |
| ***A47L 13/22*** | (2006.01) |
| ***A47L 11/40*** | (2006.01) |

(52) U.S. Cl.

CPC ..... *A47L 13/225* (2013.01); *A47L 11/34* (2013.01); *A47L 11/4088* (2013.01)

(58) Field of Classification Search

CPC .... A47L 11/34; A47L 11/4088; A47L 13/225
USPC ..... 15/320
IPC ..... A47L 11/34
See application file for complete search history.

(56) References Cited

U.S. PATENT DOCUMENTS

| | | | | |
|---|---|---|---|---|
| 3,958,298 | A * | 5/1976 | Cannan | 15/322 |
| 5,485,652 | A * | 1/1996 | Holland | 15/322 |
| 6,055,699 | A * | 5/2000 | Cho | 15/321 |
| 8,171,598 | B1 * | 5/2012 | Hiltz | 15/322 |
| 8,613,151 | B2 * | 12/2013 | Rosenzweig et al. | 38/77.8 |
| 2007/0074369 | A1 * | 4/2007 | Stuthers et al. | 15/367 |
| 2008/0066789 | A1 | 3/2008 | Rosenzweig | |
| 2010/0050367 | A1 | 3/2010 | Tsai | |
| 2011/0131753 | A1 * | 6/2011 | Krebs | 15/320 |
| 2012/0042462 | A1 | 2/2012 | Milanese | |
| 2012/0222227 | A1 * | 9/2012 | Johnson et al. | 15/105 |

OTHER PUBLICATIONS

International Search Report for Application No. PCT/GB2013/051194 dated Jan. 7, 2014 (6 pages).

* cited by examiner

*Primary Examiner* — David Redding
(74) *Attorney, Agent, or Firm* — Michael Best & Friedrich LLP

(57) ABSTRACT

A surface cleaning head for a steam cleaner, comprising a plurality of steam outlets spaced from one another on the cleaning head, for steam supplied from a steam generator, and a steam distributing device which receives the steam and supplies it to the outlets.

11 Claims, 4 Drawing Sheets

STEAM CLEANERS

BACKGROUND

This invention relates generally to steam cleaners, and more particularly to a cleaning head for a steam cleaner. The cleaning head may be of the type usable for cleaning carpets or like non-smooth surfaces.

The use of steam cleaners for cleaning floor and other surfaces is well known. For cleaning floor surfaces, a steam cleaner typically has a cleaning head comprising a body able to be moved, by a user, over the surface to be cleaned, the body being adapted to carry a cleaning element of or including a fabric/textile or other material of a steam permeable absorbent nature. Steam is emitted from the body and passes through the cleaning element to impinge on the surface being cleaned, with the effect of loosening dirt from the surface. Dirty water from condensation of the steam on the surface is absorbed by the cleaning element.

The cleaning head, to enable it to be manipulated over the surface being cleaned, may be attached to a wand and steam supplied thereto by way of a hose from a separate steam generator. Alternatively, the wand may itself be provided with a steam generator and supply of water, to form a self-contained steam cleaning device, sometimes referred to as a "stick" or "mop" type of steam cleaner. The present invention is, in principle, applicable to the cleaning head of either type of steam cleaner.

SUMMARY

One aspect of the invention is concerned with the distribution of steam in relation to the cleaning head of a steam cleaner. It has generally been the practice in steam cleaners to provide for the emission of steam from the cleaning head at one outlet or a small number of outlets, e.g. at up to three positions. This has been the case even with large cleaning heads intended for cleaning large areas of floor surfaces. The result of this is that a cleaning element carried by the cleaning head becomes locally wet with condensed steam and dirty water picked up from the surface being cleaned, while other parts of the cleaning element stay relatively dry. This can mean that the surface being cleaned is left with streaks of (possibly dirty) liquid, which dry slowly and lead to an uneven streaky or smeared appearance.

With the object of addressing this disadvantage, one aspect of the present invention provides a cleaning head for a steam cleaner, wherein the cleaning head is adapted to distribute steam to a plurality of outlets spaced from one another on the cleaning head.

Preferably the cleaning head is one which is intended to be used for cleaning floors or other surfaces with use of a cleaning element carried thereby when used on surfaces such as wood, laminate, vinyl and so forth, and possibly with a carpet glider when used on carpets or other like surfaces. However, it will be appreciated that the invention is applicable to other types of cleaning head for other purposes.

The head may comprise a steam distributing device, which may have a portion for receiving steam supplied to the cleaning head, and a plurality of passages extending from the receiving portion to the steam outlets.

The passages extending to the outlets may be arranged to provide generally the same resistance as one another to passage of steam from the receiving portion to the respective outlets, in the interests of achieving similar levels of emission of steam from all the outlets. To this end, the passages may be of similar length to one another.

Steam may enter the receiving portion in a direction generally perpendicular to the direction in which the passages extend from the receiving portion, also in the interest of achieving similar steam levels of emission from the outlets of the respective passages.

In the embodiment described hereafter, the receiving portion of the steam distribution device may be provided in a region of the cleaning head spaced from the periphery of the cleaning head, and the passages may radiate outwardly from the receiving portion to the steam outlets.

A cleaning element of textile material is relatively easily moved over a smooth floor surface such as a tiled floor. However, it cannot readily be moved over a carpeted floor, and to enable a steam cleaner to be used for this purpose, it is known to provide a steam cleaner with an accessory affording a smooth surface by which the cleaning head is supported on the floor. Such an accessory, sometimes called a "carpet glider" and herein referred to as such, typically affords a smooth support surface around a peripheral region of the cleaning head, while in a central region of the cleaning head the carpet glider has an opening through which the cleaning element is able to make relatively light contact with a carpet to effect steam cleaning thereof. It has been usual for a carpet glider to comprise an open-topped dished component upon which the cleaning head can be placed, but which is not secured thereto, so that when cleaning a carpet the carpet glider remains in situ in relation to the cleaning head as long as the cleaning head is not lifted away from the carpet. If the cleaning head is lifted, the carpet glider remains on the carpet and to resume use of the carpet glider the cleaning head must be lowered into the correct position thereon. Also, the carpet glider can become displaced relative to the cleaning head if, accidentally, it encounters an obstruction such as an item of furniture on the carpet. Such occurrences are inconvenient.

Accordingly, with the object of mitigating such inconvenience, another aspect of the present invention provides a surface cleaning head for a steam cleaner, and a carpet glider usable with the cleaning head, wherein the cleaning head and carpet glider have formations co-operable to hold the carpet glider in an operative position relative to the cleaning head. The formations may include a latching element, e.g. resilient, on one of the cleaning head and carpet glider, co-operable with a formation on the other of the head and glider.

Preferably the cleaning head and carpet glider each have at least two formations co-operable with the other to secure the head and carpet glider together. Such formations may be provided at front and rear of the head and glider, and/or opposite sides thereof, so that the head and glider are held together at spaced positions thereon, giving an appropriate degree of security of the carpet glider against unintentional removal, when fitted to the head.

The invention also provides a carpet glider for use with a surface cleaning head of a steam cleaner, wherein the carpet glider has at least one formation co-operable with the cleaning head to hold the carpet glider in an operative position relative to the cleaning head.

Both the first and second aspects of the invention as above set forth may be provided in a steam cleaner.

BRIEF DESCRIPTION OF THE DRAWINGS

The invention will now be described by way of example with reference to the accompanying drawings, of which.

DETAILED DESCRIPTION

Figure 1:
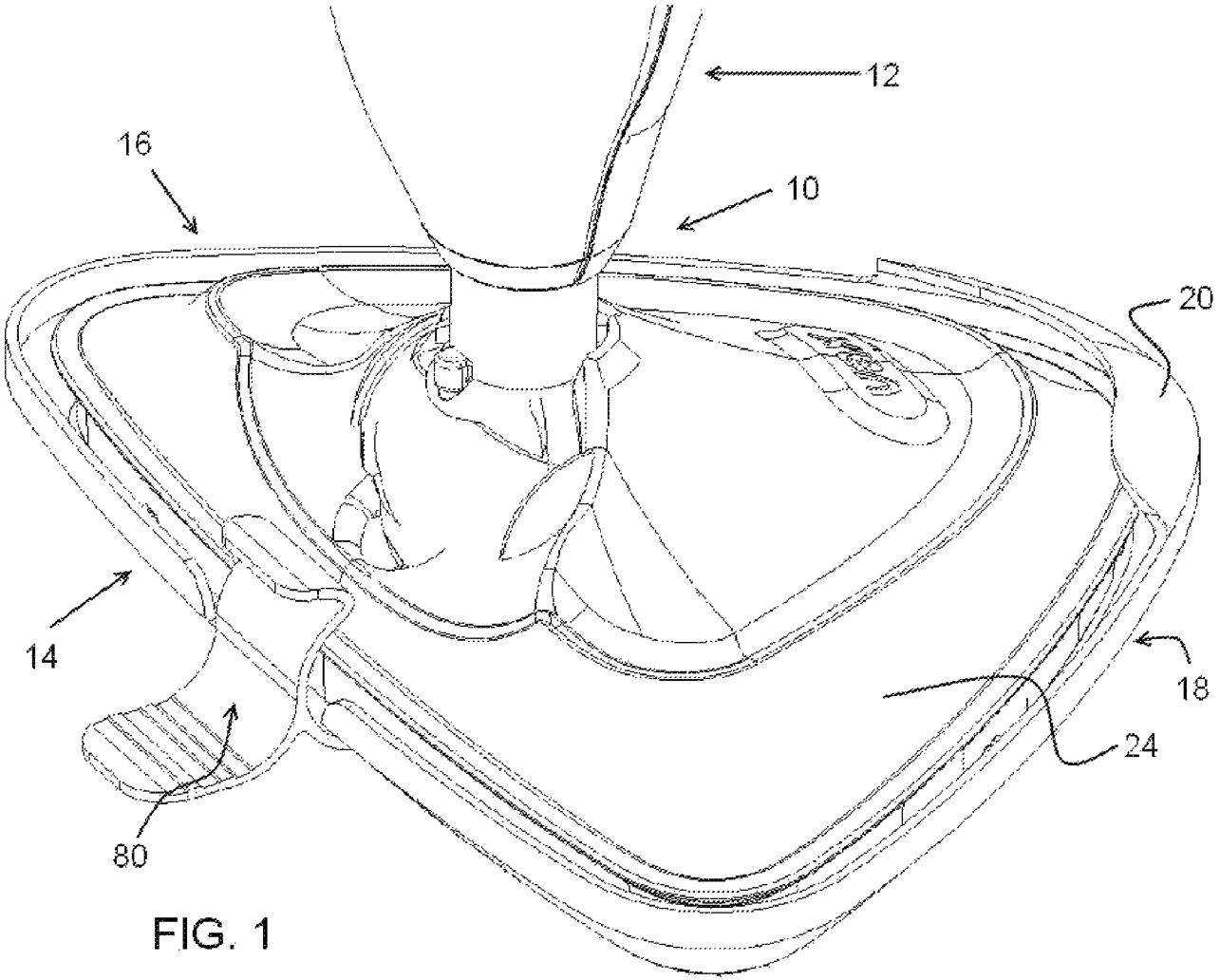
FIG. 1 is a perspective view of the exterior of the cleaning head of a steam cleaner in accordance with the invention.

Referring firstly to FIG. 1 of the drawings, the cleaning head there illustrated, and indicated generally at 10, is the head of a "stick" or "mop" type of steam cleaner, in which the head is provided as a non-removable part of a body assembly which is indicated generally at 12. The head is at the lowermost end of the body assembly when the steam cleaner is in use, and the body accommodates a tank for water and a generator for steam which is arranged to be fed with water from the tank when required, e.g. by a user-controlled electric pump, and from which steam is delivered to the cleaning head as described hereafter. At the upper end of the body 12, at a convenient distance from the head 10, the body is provided with a handle by which the user can carry the steam cleaner and manipulate it to be moved as required over a carpet or other floor surface which is being cleaned.

The cleaning head 10 is of three-sided shape in plan in the general form of an isosceles triangle albeit with outwardly curved edges and rounded "corners". An edge indicated generally at 14 of the cleaning head, which is at the rear thereof, i.e. the part nearest to a user who is using the machine normally, is only slightly curved outwardly, while left hand (16) and right hand (18) edges, extending forwardly from the respective ends of the edge 14 and converging to a rounded nose portion 20 of the head, are of greater curvature. The principal components of the cleaning head, as described hereafter, are mouldings of suitable plastics materials selected, as will be apparent to those skilled in the art, in the light of their respective functional requirements.

The cleaning head 10 is a hollow assembly of components, comprising a base 22 and a cover 24 fastened to the upper surface of the base to define a space therebetween containing the parts described hereafter. The base 22 has an upstanding peripheral wall 26. The body 12 is pivotally secured to the head firstly for pivoting movement about an axis extending transversely of the head, and FIG. 3 shows upstanding formations 28 disposed generally in mirror image of one another on opposite sides of the base 22 adjacent the rear edge 14 thereof. The formations 28 include aligned part-circular recesses as indicated at 28*a*, which receive trunions at opposite ends of generally oblate spheroidal, or cylindrical, member 30, for pivoting movement about the axis of the recesses 28*a*. The body 12 of the cleaner has a cylindrical portion 32 at its lower end, with a part spherical formation extending to the interior of the member 30 and able to pivot by formations 34 about an axis 36 which is perpendicular to, but does not intersect, the transverse pivot axis of the member 30 relative to the head of the cleaner. Hence, the body and handle of the cleaner is able not only to be tilted rearwardly relative to the head of the cleaner, from an upright position to an inclined position such as that shown in FIG. 2, but also tilted laterally about the axis 36, for when the head is to be maneuvered other than in a forwards and rearwards direction.

The cylindrical portion 32 at the lowermost end of the body 12 of the cleaner is hollow, and contains two flexible pipes (not shown). The first flexible pipe extends from the steam generator of the cleaner to a connecting sleeve 40 within the portion 32, the sleeve 40 communicating with a spigot 42 on which a further flexible pipe 44 is a push-fit. A smaller diameter flexible pipe within the portion 32 extends to a connection sleeve 46 from a source of cleaning solution (e.g. a detergent) carried by the body of the cleaner, the connection sleeve 46 leading to a spigot 48 to which a further flexible pipe 50 is push-fitted.

Figure 3:
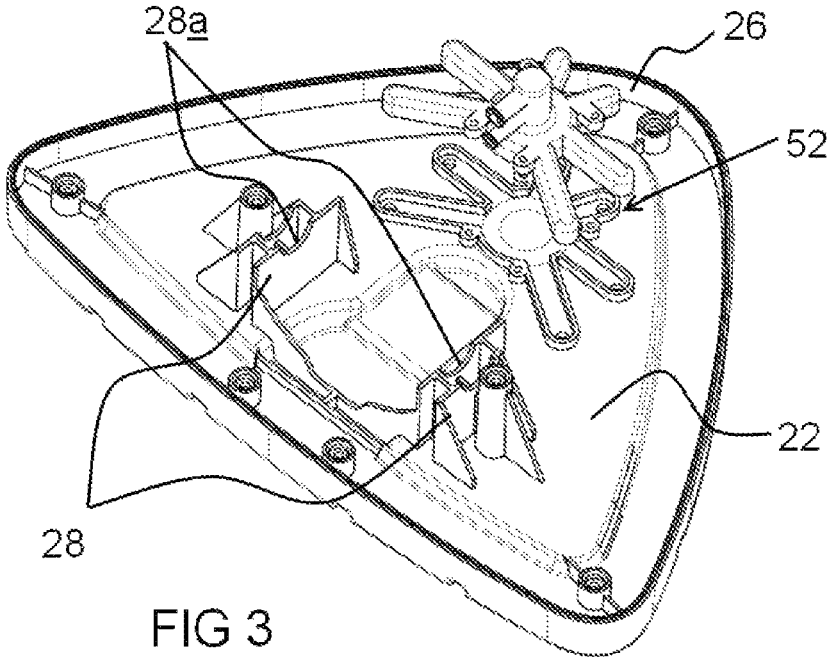
FIG. 3 is a perspective view of part of the interior of the cleaning head.
Figure 3A:
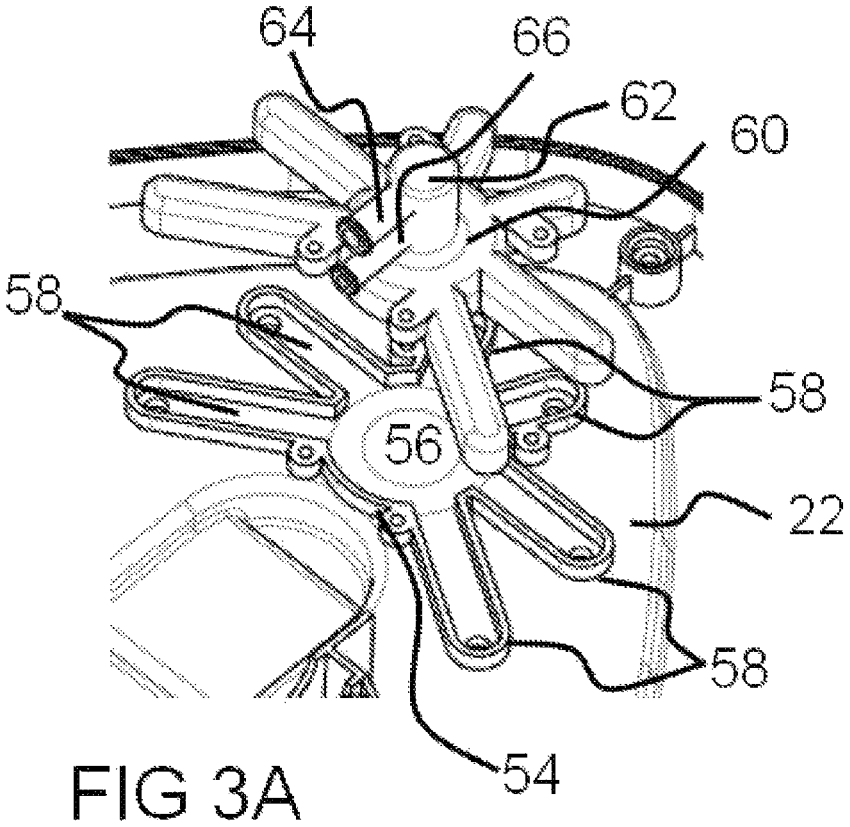
FIG. 3*a* is an enlargement of part of FIG. 3.

The flexible pipes 44, 50 lead to a steam distribution assembly indicated generally at 52 in FIG. 3 and shown in greater detail in FIG. 3*a*. The steam distribution assembly comprises a lower portion indicated generally at 54 and preferably moulded integrally with the base 22 of the cleaning. A low wall extending upwardly from the base 22 defines the lower part of a central steam-receiving chamber 56 from which six passage portions of trough-like form 58 extend generally radially outwardly. Adjacent the outermost end of each of the passage portions 58, there is an aperture extending through the base 22 for emission of steam towards the surface on which the cleaning head is being used.

The steam distribution assembly 52 further comprises an upper body part 60 which in plan view is of the same shape as the lower portion of the assembly, comprising a central part affording a downwardly facing recess to form the upper part of the chamber 56, and a number of limbs radiating outwardly therefrom affording downwardly-facing grooves facing the passage portions 58. A central region of the body part 60 has an upwardly extending cylindrical portion 62 with spigots 64, 66 to which the flexible tubes 44, 50 are respectively push-fitted.

Therefore, steam supplied to the distribution assembly 52 by way of the flexible tube 44 enters the chamber 56 downwardly, and is distributed through the passages radiating from the chambers to be emitted from the underneath of the cleaning head through a number of the apertures provided at the ends of the passage portions 58.

Although not illustrated in the drawings, the cleaning head is provided with attachment means for securing a cleaning element, e.g. of textile material as above mentioned, to the underside of the cleaning head. Such attachment means may include one or more of clips, clamps, hook and loop (Velcro™) fastening devices, or any other appropriate means by which a textile element may be secured to a plastics structure.

Figure 2:
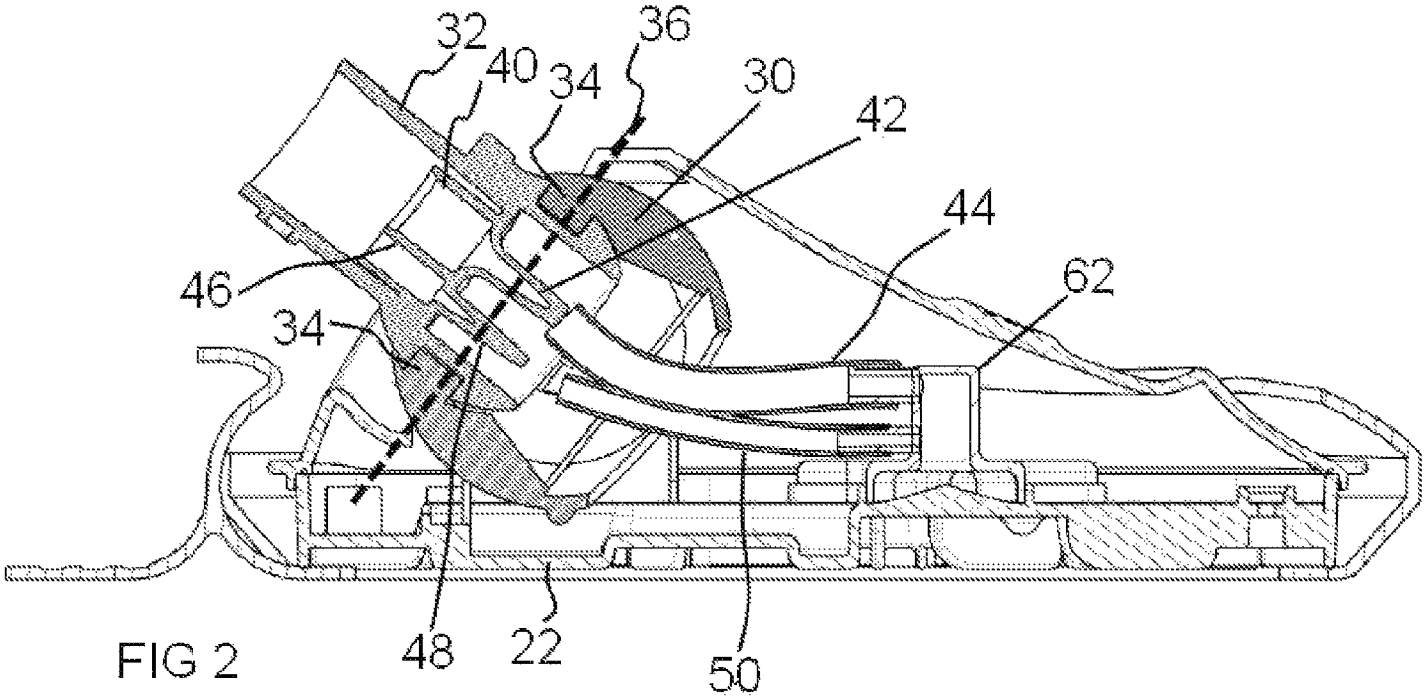
FIG. 2 is a cross-sectional view, in a plane extending from front to rear of the cleaning head of FIG. 1.
Figure 4B:
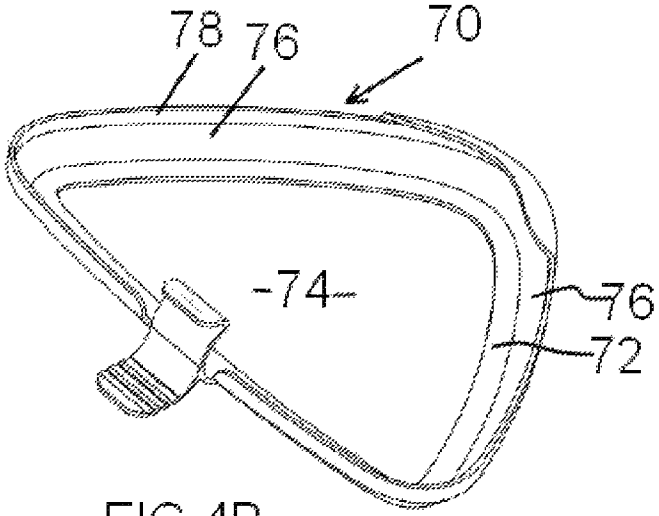
FIGS. 4*a* and 4*b* are perspective views, from different directions, of a carpet glider for the cleaning head.
Figure 4A:
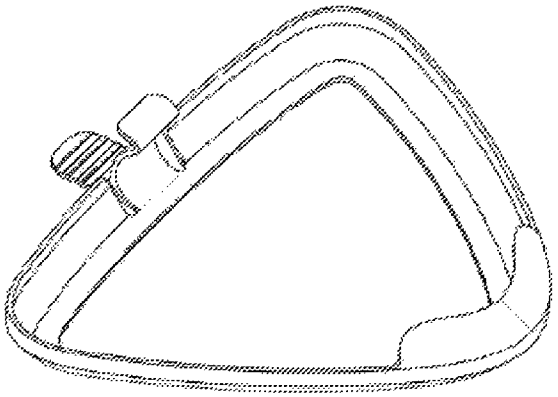
Figure 4C:
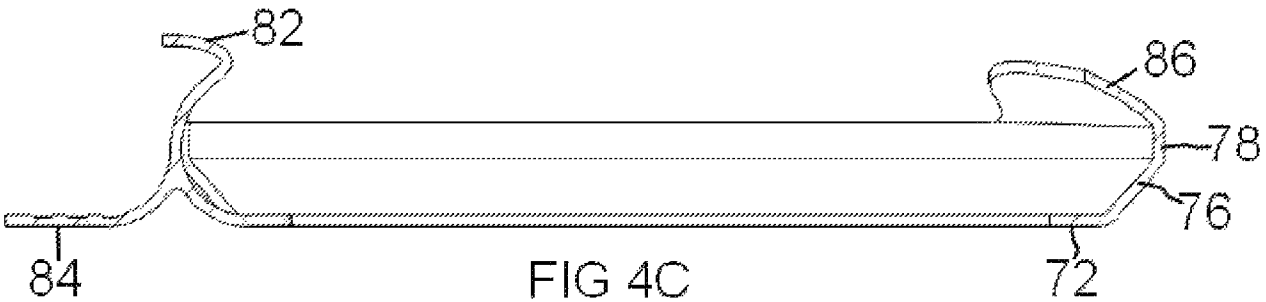
FIG. 4*c* is a section through the carpet glider.

A carpet glider for the above-described cleaning head is shown in FIGS. 4*a* to 4*c*, and is shown in position in relation to the cleaning head in FIGS. 1 and 2. The carpet glider 70 is, in plan view, the same overall shape as the cleaning head itself, with three curved edges and rounded corners between them. It comprises a planar base wall portion 72 which defines an opening 74 whose dimensions are slightly smaller than those of the base 22 of the cleaning head, so that when the carpet glider is fitted to the cleaning head all but a marginal portion of the head and cleaning element is presented through the opening 74 to the surface on which the cleaner is to be used. An inclined peripheral wall 76 extends upwardly and outwardly from the outer edge of the wall 72, followed by an upright wall portion 78.

At the rear of the carpet glider, midway along its rear edge, a retaining formation indicated generally at 80 is provided. This has a latching portion 82 engageable with the cleaning head and a manually-moveable operating portion 84, the clip formation extending from the base wall portion 72 of the carpet glider but being separate from the peripheral wall portions 76, 78 so that by pressing on the operating portion 84 the clip formation is able to be pivoted and the latch formation 82 able to be withdrawn rearwardly from engagement with the cleaning head. Opposite the clip formation 80, the carpet glider has a retention portion 86 which, when the carpet glider is fitted to the cleaning head extends over the nose portion 20 of the cleaning head so that the combination of the retaining formation 80 and retention portion 86 hold the nose part of the carpet glider in position of the cleaning head.

By virtue of the above-described provision of the retaining mechanism for the carpet glider, and the steam distribution assembly, a steam cleaner is rendered more convenient in use and also more effective in terms of its steam distribution over a cleaning element, lessening the likelihood that water deposition and uneven drying might occur.

It will be appreciated that modifications from the above-described construction may be made within the scope of the invention as set forth in the following claims. For example, the steam distribution passages above described are partially afforded by formations which form part of the structure of the cleaning head: it would be possible for such passages to be provided entirely by separate components from those which constitute the cleaning head structure.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A surface cleaning head for a steam cleaner, comprising a plurality of steam outlets spaced from one another on the cleaning head, for steam supplied from a steam generator, and a steam distributing device which receives the steam and supplies it to the outlets, and the steam distributing device comprises central steam receiving chamber for receiving the steam from the steam generator, and a plurality of passages extending from the central steam receiving chamber to the steam outlets wherein the central steam receiving chamber of the steam distribution device is provided in a region of the cleaning head spaced from the periphery thereof, and the passages radiate outwardly from the central steam receiving chamber directly to the steam outlets, and wherein steam enters the central steam receiving chamber in a direction generally perpendicular to the direction in which the passages extend from the central steam receiving chamber, at least one formation adapted to co-operate with a carpet glider to hold the carpet glider in an operative position relative to the cleaning head, a carpet glider usable therewith including a latching element on the cleaning head or carpet glider, co-operable with a formation on the glider or cleaning head respectively, wherein the latching element is resiliently displaceable for engagement with and disengagement from the cleaning head or glider.

2. A cleaning head according to claim 1 wherein the passages are arranged to provide a generally similar resistance as one another to the passage of steam from the central steam receiving chamber to the respective outlets.

3. A cleaning head according to claim 2 wherein the passages are of similar length to one another.

4. A cleaning head according to claim 1 wherein the passages are at least partly defined in a body member of the cleaning head.

5. A cleaning head and carpet glider according to claim 1, including a retention portion on the head or glider, affording a recess within which a part of the glider or head is receivable.

6. A carpet glider for use with a surface cleaning head of a steam cleaner according to claim 1, wherein the carpet glider has at least one formation co-operable with the cleaning head to hold the carpet glider in an operative position relative to the cleaning head.

7. A carpet glider according to claim 6 wherein the at least one formation includes a latching element co-operable with the cleaning head.

8. A carpet glider according to claim 6 wherein the at least one formation includes a retention formation wherein a part of the cleaning head is receivable.

9. A surface cleaning head for a steam cleaner, comprising a plurality of steam outlets spaced from one another on the cleaning head, for steam supplied from a steam generator, and a steam distributing device which receives the steam and supplies it to the outlets, and the steam distributing device comprises central steam receiving chamber for receiving the steam from the steam generator, and a plurality of passages extending from the central steam receiving chamber to the steam outlets wherein the central steam receiving chamber of the steam distribution device is provided in a region of the cleaning head spaced from the periphery thereof, and the passages radiate outwardly from the central steam receiving chamber directly to the steam outlets, and wherein steam enters the central steam receiving chamber in a direction generally perpendicular to the direction in which the passages extend from the central steam receiving chamber, wherein the carpet glider has at least one formation co-operable with the cleaning head to hold the carpet glider in an operative position relative to the cleaning head, wherein the at least one formation includes a latching element co-operable with the cleaning head, and wherein the latching element is resiliently displaceable to be engaged with or disengaged from the cleaning head.

10. A surface cleaning head for a steam cleaner, and a carpet glider usable with the cleaning head according to claim 6, wherein the cleaning head and carpet glider have formations co-operable to hold the carpet glider in an operative position relative to the cleaning head.

11. A cleaning head according to claim 1 wherein the receiving portion of the steam distribution device is provided in a region of the cleaning head spaced from the periphery thereof, and the passages radiate outwardly from the receiving portion to the steam outlets.

* * * * *